US005903249A

United States Patent [19]

Koyama et al.

[11] Patent Number: 5,903,249

[45] **Date of Patent: *May 11, 1999**

[54] METHOD FOR DRIVING ACTIVE MATRIX DISPLAY DEVICE

[75] Inventors: Jun Koyama; Yuji Kawasaki, both of Kanagawa, Japan

[73] Assignee: Semiconductor Energy Laboratory Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/538,016

[22] Filed: Oct. 2, 1995

[30] Foreign Application Priority Data

Oct. 7, 1994 [JP] Japan ..... 6-270367

[51] Int. Cl.[6] ..... G09G 3/36

[52] U.S. Cl. ..... 345/92; 345/93; 349/48

[58] Field of Search ..... 345/90, 91, 92, 345/93, 94, 95, 96, 97, 98, 205, 206; 349/42, 48

[56] References Cited

U.S. PATENT DOCUMENTS

| | | | |
|---|---|---|---|
| 4,623,908 | 11/1986 | Oshima et al. | 357/23.7 |
| 4,775,861 | 10/1988 | Saito | 345/93 |
| 4,870,396 | 9/1989 | Shields | 345/90 |
| 4,994,796 | 2/1991 | Kuijk | 345/93 |
| 5,012,228 | 4/1991 | Masuda et al. | 345/88 |
| 5,021,774 | 6/1991 | Ohwada et al. | 345/90 |
| 5,051,739 | 9/1991 | Hayashida et al. | 345/90 |
| 5,165,075 | 11/1992 | Hiroki et al. | 345/93 |
| 5,315,396 | 5/1994 | Miyadera | 345/90 |
| 5,436,635 | 7/1995 | Takahara et al. | 345/92 |
| 5,448,258 | 9/1995 | Edwards | 345/92 |
| 5,473,451 | 12/1995 | Kazurov et al. | 345/93 |
| 5,489,867 | 2/1996 | Tamanoi | 345/98 |
| 5,506,598 | 4/1996 | Shimada et al. | 345/94 |
| 5,526,012 | 6/1996 | Shibahara | 345/92 |

FOREIGN PATENT DOCUMENTS 02141725 5/1990 Japan .

*Primary Examiner*—Lun-Yi Lao

*Attorney, Agent, or Firm*—Edward D. Manzo; Mark J. Murphy

[57] ABSTRACT

The object of the invention is to design for reduction of the effects of thin-film transistor OFF current and to improve image quality in an active matrix display device in which polysilicon thin-film transistors are used.

Plural serially connected thin-film transistors are provided for one pixel electrode, different signals are imposed on the gate terminals of respective thin-film transistors, and a signal is written into the pixel when all the serially connected thin-film transistors are in an on state.

Further, since the thin-film transistors are connected in series, the voltage imposed on the source and drain electrodes when they are all in an off state is divided, and consequently the voltage across the source and drain electrodes of the thin-film transistor that drives the pixel is smaller and the OFF current is reduced.

3 Claims, 6 Drawing Sheets

METHOD FOR DRIVING ACTIVE MATRIX DISPLAY DEVICE

BACKGROUND OF THE INVENTION

1. Field of the Invention

The present invention relates to an active matrix display device which is designed to improve the image quality on the display screen of an active matrix display device.

2. Description of the Related Art

FIG. 2 schematically shows a conventional example of an active matrix display device. The region 204 enclosed by the dashed line in the drawing is a display region, and thin-film transistors 201 are provided in a matrix array in this region. The line connected to the source electrode of a thin-film transistor 201 is an image (data) signal line 206, and the line connected to its gate electrode is a gate (selection) signal line 205.

Considering now the drive element, the thin-film transistor 201 affects data switching and drives a pixel cell 203. A capacitance 202 provides for holding image data in a capacitor. The thin-film transistor 201 provides for switching image data constituted by voltages that are imposed on the pixel. Designating the gate voltage of the thin-film transistor as Vg and its drain current as Id, the relationship of Vg-Id is shown in FIG. 3. That is, when the gate voltage is in the thin-film transistor's off region, Id becomes large. This is called the OFF current.

In the case of an N-channel thin-film transistor, when Vg is negatively biased, the OFF current is determined by the current that flows in a PN junction, which is formed between a P-type layer, which is induced at the surface of the semiconductor thin film and an N-type layer between the source region and the drain region. Since, many traps are present in the semiconductor thin film, this PN junction is imperfect, and the flow of junction leakage current can easily occur. The reason why the OFF current becomes greater with increasing negative bias on the gate electrode is that the carrier concentration in the P-type layer formed at the surface of the semiconductor thin film increases, and the energy barrier at the PN junction becomes narrower. Consequently the field becomes concentrated, and the junction leakage current increases.

The OFF current that arises in this manner is greatly dependent on the source-drain voltage. For example, it is known that the OFF current increases dramatically as the voltage imposed across the source and drain of a thin-film transistor becomes larger. In more detail, the OFF current when a voltage of 10 V is imposed across the source and drain is not double the OFF current that flows when a voltage of 5 V is imposed but instead may be as much as 10 times or even 100 times greater. This nonlinearity is also dependent on the gate voltage. Generally, the difference between the two is considerable when the value of the gate electrode reverse bias is large (a large negative voltage in the case of an N-channel type element).

A circuit diagram of a conventional X shift register is shown in FIG. 4 (A). This X shift register is a circuit which produces gate electrode on/off timing for thin-film transistors that drive the pixel electrodes of an active matrix display device. The output signals of the shift register, which, as is clear from FIG. 4 (A), is constituted by flipflops, are as shown in FIG. 4 (B). ANDing of adjacent signals within these output signals gives a signal plot such as in FIG. 4 (C) with which the thin-film transistors of each row in an active matrix display device are successively brought to an on state.

SUMMARY OF THE INVENTION

An essential feature of the present invention is that it provides a thin-film transistor possessing a structure which reduces OFF current. A characteristic demanded of a thin-film transistor in this case is that it be possible to produce sufficient flow of current to charge an auxiliary capacitor when the transistor is in an on state but that current be suppressed as much as possible when the transistor is brought to an off state. The fact that, as shown in FIG. 3, the drain current increases when Vg is in the region in which the thin-film transistor is turned off shows that the OFF current is dependent on the gate voltage, which is undesirable as a thin-film transistor characteristic. Reduction of the OFF current contributes to improvement of the thin-film transistor characteristics and leads to improvement of the performance of an active matrix display device. This is because charges sufficient for driving pixels are stored in the capacitors. But when the OFF current is large, capacitances are discharged and the stored charges change, resulting in breakdown of image data that are supposed to be displayed by pixels.

The basic concept of the present invention is that, as shown in FIG. 1 (A), thin-film transistors 101 and 102 are connected in series to a pixel cell 104, and thanks to the voltage that appears across the source and drain of the pixel electrode thin-film transistor 102 in particular is reduced. In other words, the OFF current of the thin-film transistor 102 is reduced.

This can be explained as follows in terms of physical characteristics.

When a thin-film transistor is in an on state, a channel is formed at the surface of the semiconductor thin film. Consequently a generally uniform potential gradient is formed, going from the source towards the drain, and so, the channel is divided up, and the drain current does not change. On the other hand, when the thin-film transistor is in the off state, since most of the field is concentrated in the PN junction in the vicinity of the drain as described above, making a division into thin-film transistors makes it possible to weaken the field concentration to which the PN junction is subjected, and hence reduce the junction leakage current, i.e., the OFF current.

To describe now the specific operation, as shown in FIG. 5 (A), the X shift register used in the present invention is a register in which, in contrast to the conventional shift register of FIG. 4 (A), AND gates are omitted.

When, as shown in FIG. 5 (B), at time T1, output G1 becomes 'H' level and output G2 is 'L' level and selection signals are supplied to gate signal lines 105 and 106, thin-film transistor 101 is turned on, and thin-film transistor 102 is turned off. At time T2, when output G1 is 'H' level and output G2 becomes 'H' level and selection signals are supplied to gate signal lines 105 and 106, thin-film transistors 101 and 102 are turned on, and, in response to a signal on an image signal line 107, a capacitor 103 and a pixel cell 104 are charged. In the (equilibrium) stage when full charging has been affected, the state becomes one in which the voltages across the sources and drains of thin-film transistors 101 and 102 are more or less equal.

When, at time T3, output G1 becomes 'L' level and output G2 is 'H' level and selection signals are supplied to gate signal lines 105 and 106, thin-film transistor 101 is turned off, and thin-film transistor 102 is turned on. An image signal line 107 signal is not supplied to pixel cell 104 at this time. Since thin-film transistor 102 is turned on and there is a finite OFF current in thin-film transistor 101, the charge with which capacitor 103 has been charged is discharged to an amount corresponding to this OFF current, so resulting in a fall in the voltage.

When, at time T4, outputs G1 and G2 are 'L' level and selection signals are supplied to gate signal lines 105 and 106, thin-film transistors 101 and 102 are turned off. Since there are finite OFF currents in thin-film transistor 101 and 102, the charge with which the capacitor 103 has been charged is discharged, and the voltage falls.

To compare the OFF currents that flow in the thin-film transistors at times T3 and T4, since the state at time T3 is equivalent to connection of one thin-film transistor (101) in an off state, the flow of OFF current is smaller in the state of time T4 in which two thin-film transistors are connected in an off state.

In terms of display device operation, since the duration of the state of time T4 is much greater than that of the state of time T3, the situation relating to OFF current is much better than it is with a single thin-film transistor.

Effects are improved if the thin-film transistors used in the present invention have LDD regions or offset regions in their channels. This is because an LDD region or offset region constitutes a resistance component which causes a potential drop and weakens the field, and so helps reduce OFF current.

DETAILED DESCRIPTION OF THE PREFERRED EMBODIMENTS

EXAMPLE 1

Figure 1A:
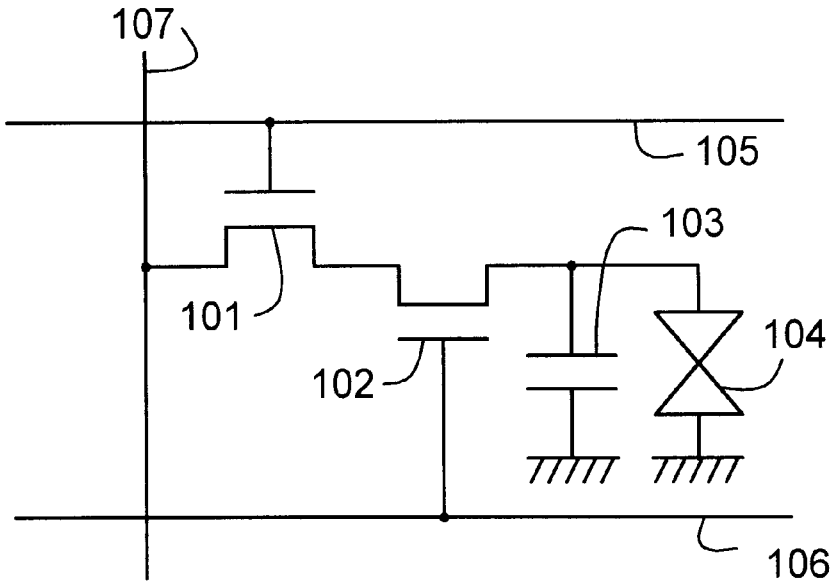
FIGS. 1(A) to 1(D) show examples of active matrix circuit elements according to the present invention.
Figure 1B:
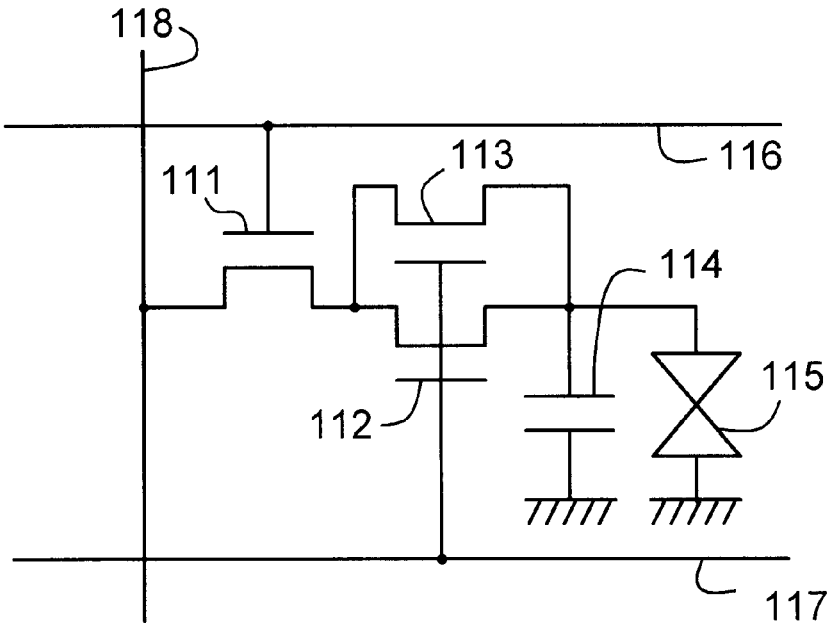
Figure 1C:
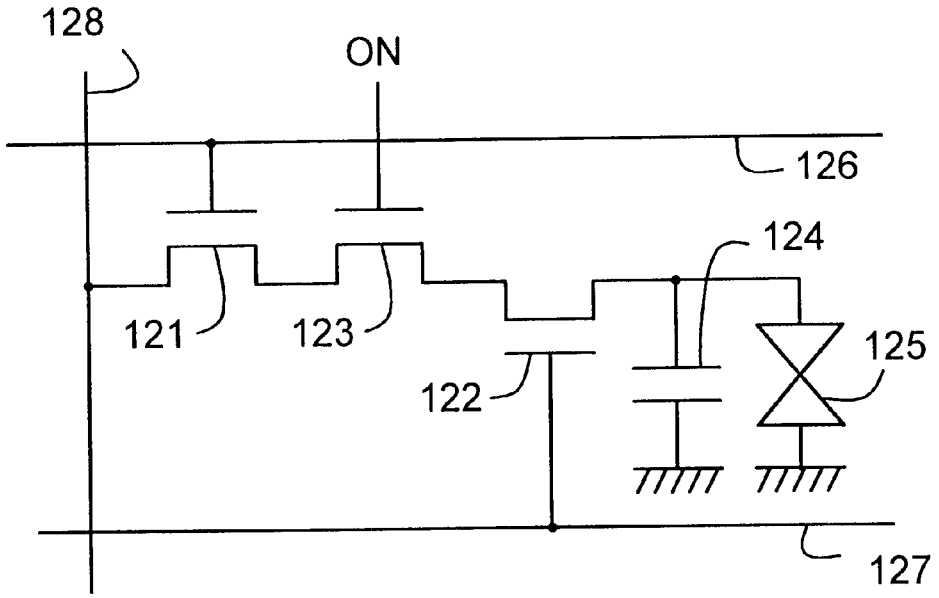
Figure 1D:
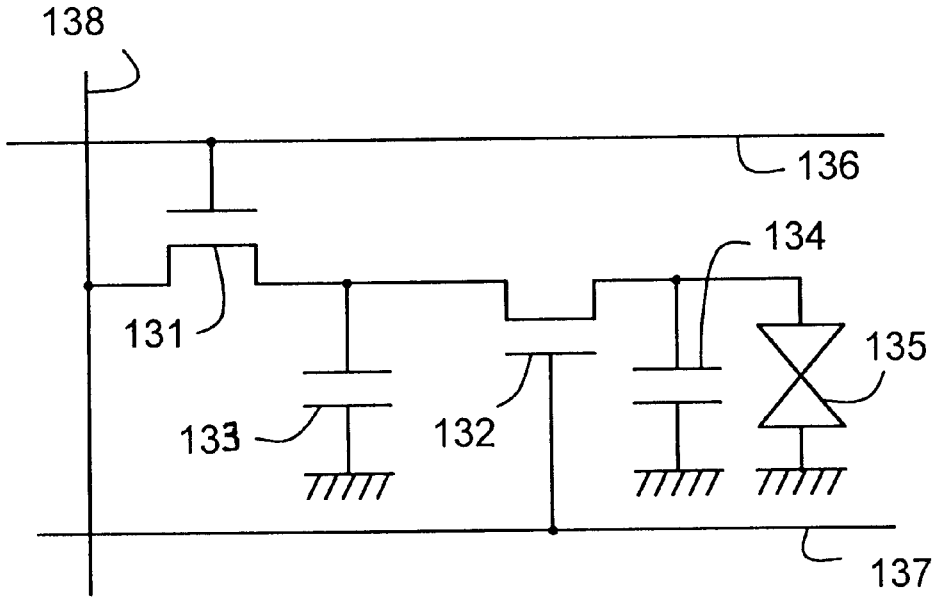
Figure 2:
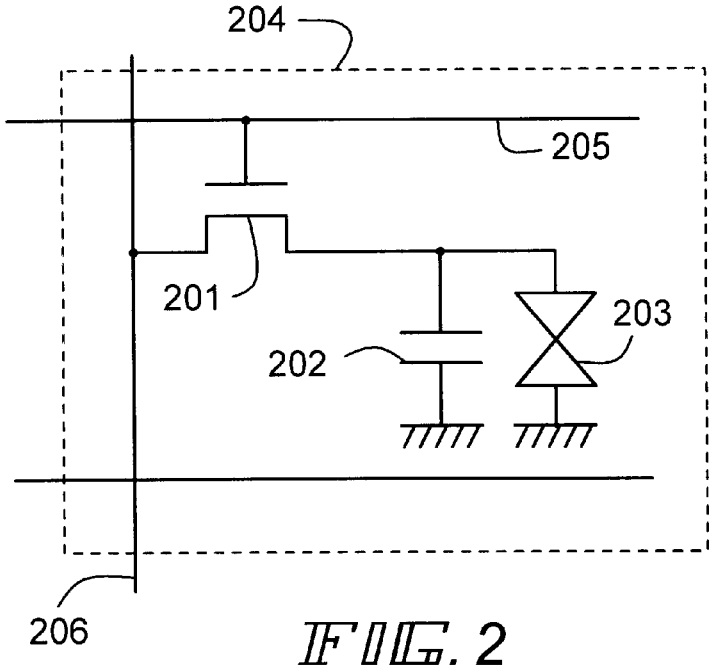
FIG. 2 (PRIOR ART)
FIG. 2 schematically shows a conventional active matrix circuit.
Figure 3:
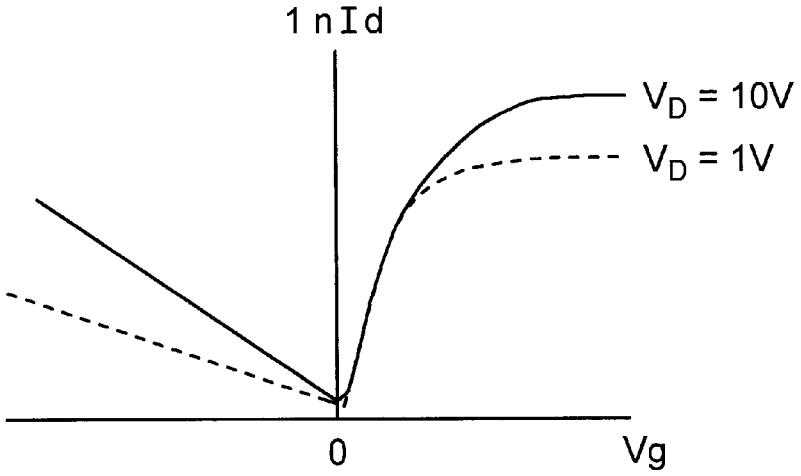
FIG. 3 (PRIOR ART)
FIG. 3 shows the Vg-Id characteristic of a thin-film transistor.
Figure 4A:
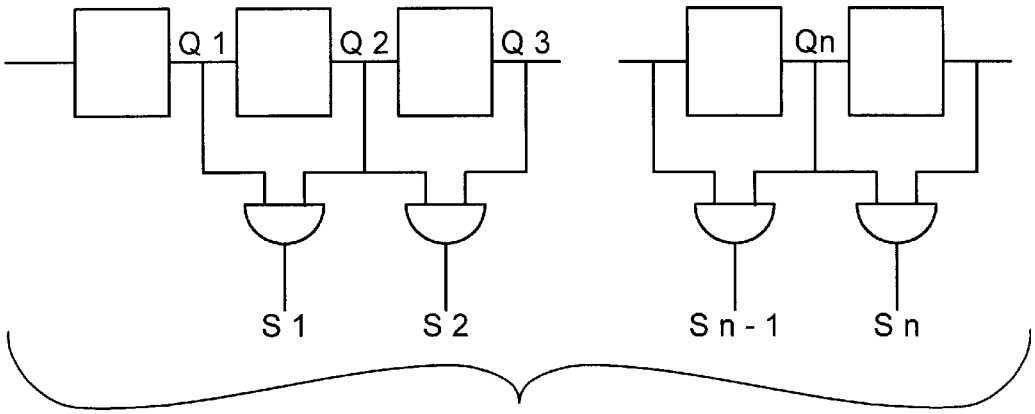
FIG. 4A (PRIOR ART)
FIG. 4(A) shows a conventional X shift register circuit configuration.
Figure 4B:
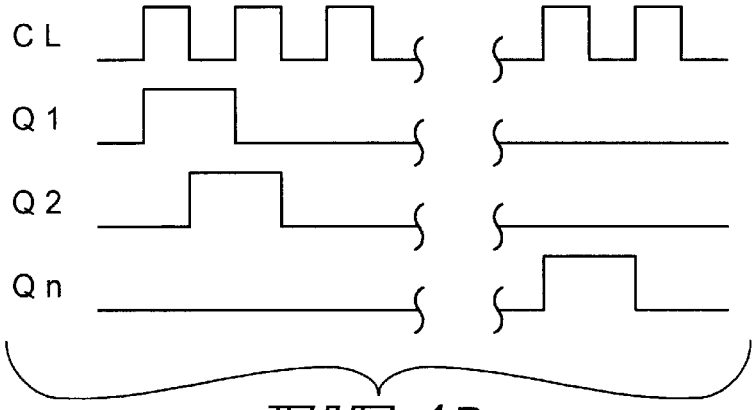
FIG. 4B (PRIOR ART)
Figs. 4(B) to 4(C) show signal timing for the X shift register circuit of FIG. 4 (A).
Figure 4C:
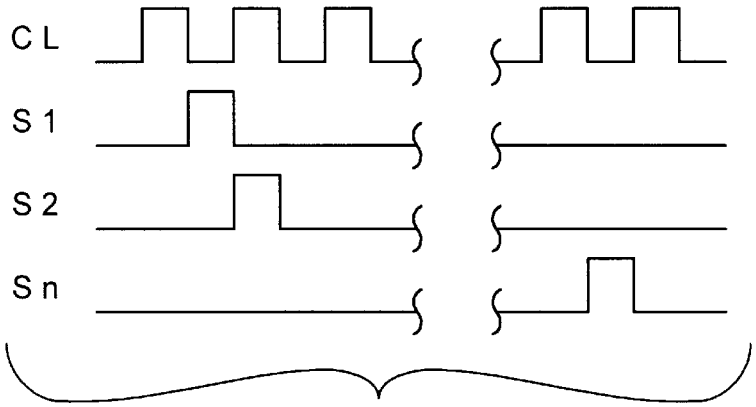
FIG. 4C (PRIOR ART)
Figure 5A:
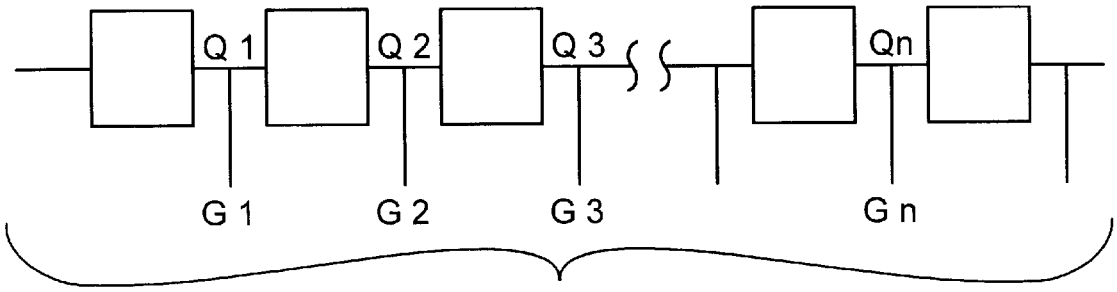
FIG. 5(A) shows an X shift register circuit configuration according to the present invention.
Figure 5B:
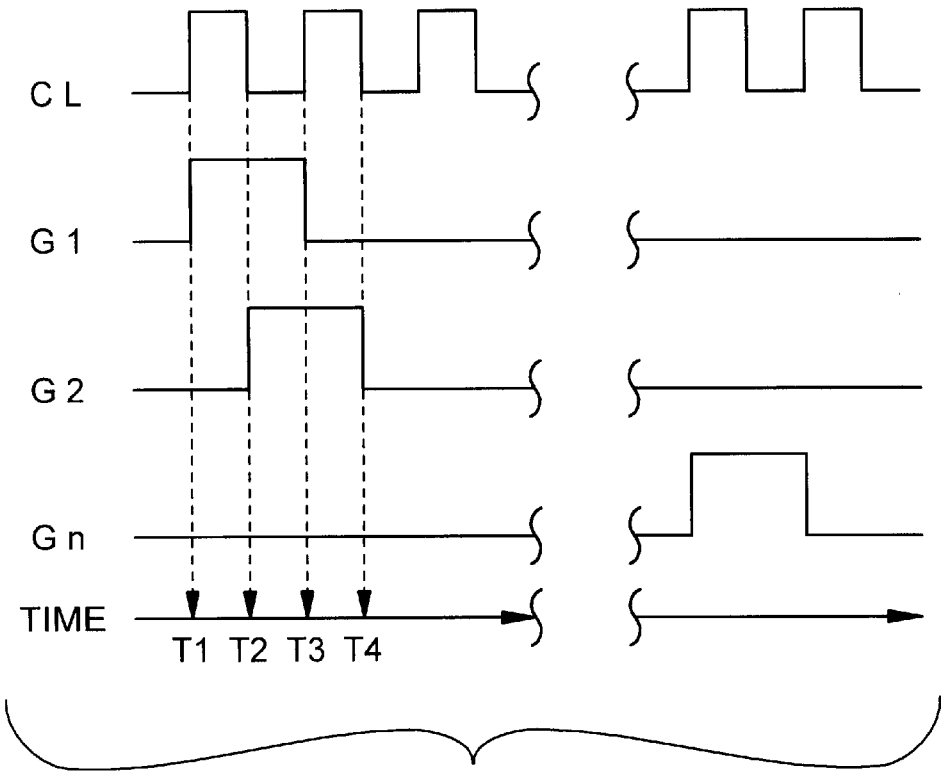
FIG. 5 (B) shows signal timing for the X shift register circuit of FIG. 5 (A).

FIG. 1 (A) shows an example of an active matrix display system in which two thin-film transistors are connected in series to one electrode of a single pixel cell. The thin-film transistors are both N-channel type elements, but it would be the same if they are made P-channel type elements. In fact, in thin-film transistors using low-temperature-formed crystalline silicon semiconductors, it is a feature of P-channel type elements that their OFF current is smaller, and they are less prone to deterioration.

Two thin-film transistors 101 and 102 are connected to different gate signal lines 105 and 106 that are respectively adjacent thereto. The source electrode of thin-film transistor 101 is connected to an image signal line 107.

A pixel cell 104 and a capacitor 103 are connected to the drain electrode of thin-film transistor 102. It is satisfactory if the other electrodes of pixel cell 104 and capacitor 103 are connected to ground. If the capacitance of pixel cell 104 is sufficiently great, capacitor 103 may be dispensed with.

The operation of FIG. 1 (A) will now be described. First, 'H' level voltage is imposed on the gate electrodes of the two thin-film transistors 101 and 102, and thin-film transistor 101 is turned on. Then, current corresponding to an image signal flows in the source of thin-film transistor 101, current then flows from the source electrode to the drain electrode of thin-film transistor 102, which is connected to the drain electrode of thin-film transistor 101. Capacitor 103 and pixel cell 104 are then charged.

Next, on imposition of 'L' level voltage on the gate electrode of thin-film transistor 101 and 'H' level voltage on the gate electrode of thin-film transistor 102, thin-film transistor 101 is turned off, and its source electrode voltage falls. OFF current flows in correspondence to the charge stored in capacitor 103, and discharge starts.

On imposition of 'L' level voltage on the gate electrodes of thin-film transistors 101 and 102, thin-film transistors 101 and 102 are turned off. Since the voltage imposed on the source and drain electrodes of each of the thin-film transistors 101 and 102 is halved, the OFF current becomes smaller than it would be if only thin-film transistor 101 were turned off. Therefore, the amount of capacitor 103 and pixel cell 104 discharge is less than it would be if only thin-film transistor 101 were turned off.

EXAMPLE 2

FIG. 1 (B) shows an example of an active matrix display system in which three thin-film transistors are connected to one electrode of a single pixel cell. The thin-film transistors are both N-channel type elements, but it would be the same if they are made P-channel type elements. In fact, in thin-film transistors using low-temperature-formed crystalline silicon semiconductors, it is a feature of P-channel type elements that their OFF current is smaller, and they are less prone to deterioration.

Two thin-film transistors 111 and 112 are respectively connected to different gate signal lines 116 and 117. One thin-film transistor 113 is connected in parallel to thin-film transistor 112. The source electrode of thin-film transistor 111 is connected to an image signal line 118.

A pixel cell 115 and a capacitor 114 are connected to the drain electrode of thin-film transistor 112. It is satisfactory if the other electrodes of pixel cell 115 and capacitor 114 are connected to ground. If the capacitance of pixel cell 115 is sufficiently great, capacitor 114 may be dispensed with.

The operation of FIG. 1 (B) will now be described. First, 'H' level voltage is imposed on the gate electrodes of the three thin-film transistors 111–113, and these transistors are turned on. Then, current in corresponding to an image signal flows in the source of thin-film transistor 111, current flows from the sources to the drains of thin-film transistors 112 and 113, which are connected to the drain of thin-film transistor 111, and capacitor 114 and pixel cell 115 are charged.

Next, on imposition of 'L' level voltage on the gate electrode of thin-film transistor 111 and 'H' level voltage on the gate electrodes of thin-film transistors 112 and 113, thin-film transistor 111 is turned off, and its source electrode voltage falls. OFF current flows in correspondence to the charge stored in capacitor 114, and discharge commences.

Further, on imposition of 'L' level voltage on the gate electrodes of thin-film transistors 111, 112 and 113, all the thin-film transistors 111–113 are turned off. Since the voltage imposed on the source and drain electrodes of thin-film transistors 111 and 112 is halved, the OFF current becomes smaller than it would be if only thin-film transistor 111 were turned off. Therefore, the amount of discharge of capacitor 114 and pixel cell 115 is less than it would be if only thin-film transistor 111 were turned off.

In this case, thin-film transistor 113 serves to provide redundancy for thin-film transistor 112, but, since it is connected in parallel, it has no effect on OFF current. It is effective in terms of design for high efficiency of a display section if there is connection in parallel to the thin-film transistor 111 or if there is connection in parallel to each of the thin-film transistors 111 and 112.

EXAMPLE 3

FIG. 1 (C) shows an example of an active matrix display system in which three thin-film transistors are connected to one electrode of a single pixel cell. The thin-film transistors are both N-channel type elements, but it would be the same if they are made P-channel type elements. In fact, in thin-film transistors using low-temperature-formed crystalline silicon semiconductors, it is a feature of P-channel type elements that their OFF current is smaller, and they are less prone to deterioration.

Two thin-film transistors 121 and 122 are respectively connected to different gate signal lines 126 and 127. The source of thin-film transistor 121 is connected to an image signal line 128. A thin-film transistor 123 that is normally on is connected between the two thin-film transistors 121 and 122. In order to bring thin-film transistor 123 to a state in which it is normally on, it is desirable to supply a sufficiently high positive potential such that hardly any effects are had by image signals, etc.

A pixel cell 125 and a capacitor 124 are connected to the drain electrode of thin-film transistor 122. It is satisfactory if the other electrodes of pixel cell 125 and capacitor 124 are connected to ground. If the capacitance of pixel cell 125 is sufficiently great, capacitor 124 may be dispensed with.

The operation of FIG. 1 (C) will now be described. First, 'H' level voltage is imposed on the gate electrodes of the two thin-film transistors 121 and 122, and these transistors are turned on. Then, current corresponding to an image signal flows in the source of thin-film transistor 121, and the normally on thin-film transistor 123, which is connected to the drain of thin-film transistor 121, functions as a capacitor, and charging commences. Since thin-film transistor 123 is normally on, current flows from the source to the drain electrodes of thin-film transistors 122 and 123 connected to the drain of thin-film transistor 121, and capacitor 124 and pixel cell 125 are charged.

Next, on imposition of 'L' level voltage on the gate electrode of thin-film transistor 121 and 'H' level voltage on the gate electrode of thin-film transistor 122, thin-film transistor 121 is turned off, and its source electrode voltage falls. OFF current flows in correspondence to the charge stored in the normally on thin-film transistor 123, and discharge commences. After that, OFF current flows in correspondence to the charge stored in capacitor 124 and discharge commences.

Then, on imposition of 'L' level voltage on the gate electrodes of thin-film transistors 121 and 122, these transistors are turned off. Since the voltage imposed on the source-drain electrodes of each of the thin-film transistors 121 and 122 is halved, the OFF current is smaller than it would be if only thin-film transistor 121 were turned off. Therefore, the amount of discharge of capacitor 124 and pixel cell 125 is less than it would be if only thin-film transistor 121 were turned off.

EXAMPLE 4

FIG. 1 (D) shows an example of an active matrix display system in which two thin-film transistors are connected to one electrode of a single pixel cell. The thin-film transistors are both N-channel type elements, but it would be the same if they are made P-channel type elements. In fact, in thin-film transistors using low-temperature-formed crystalline silicon semiconductors, it is a feature of P-channel type elements that their OFF current is smaller, and they are less prone to deterioration.

Two thin-film transistors 131 and 132 are respectively connected to different gate signal lines 136 and 137. The source electrode of thin-film transistor 131 is connected to an image signal line 138.

A pixel cell 135 and a capacitor 134 are connected to the drain electrode of thin-film transistor 132. It is satisfactory if the other electrodes of pixel cell 135 and capacitor 134 are connected to ground. If the capacitance of pixel cell 104 is sufficiently great, capacitor 103 may be dispensed with.

The operation of FIG. 1 (D) will now be described. First, 'H' level voltage is imposed on the gate electrodes of the two thin-film transistors 131 and 132, and these transistors are turned on. Then, current in corresponding to an image signal flows in the source of thin-film transistor 131, and charging of an MOS capacitor 133 connected to the drain of thin-film transistor 131 commences. Current flows from the source to the drain of thin-film transistor 132, which is connected to the drain of thin-film transistor 131, and capacitor 134 and pixel cell 135 are charged.

Next, on imposition of 'L' level voltage on the gate electrode of thin-film transistor 131 and 'H' level voltage on the gate electrode of thin-film transistor 132, thin-film transistor 131 is turned off, and its source electrode voltage falls. OFF current flows in correspondence to the charge stored in MOS capacitor 133 and discharge commences. After that, OFF current flows in correspondence to the charge that has been stored in capacitor 134, and discharge commences.

Further, on imposition of 'L' level voltage on the gate electrodes of thin-film transistors 131 and 132, these transistors are turned off. Since the voltage imposed on the source-drain electrodes of thin-film transistors 131 and 132 is halved, the OFF current is less that it would be if only thin-film transistor were turned off. Therefore, the amount of discharge of capacitor 134 and pixel cell 135 is less than it would be if only thin-film transistor 131 were turned off.

EXAMPLE 5

This example relates to the process of manufacture of the circuits described in Examples 1–4. A special feature in this example is that OFF current is reduced through the constitution of offset gates by anodic oxidation of gate electrodes.

Figure 6A:
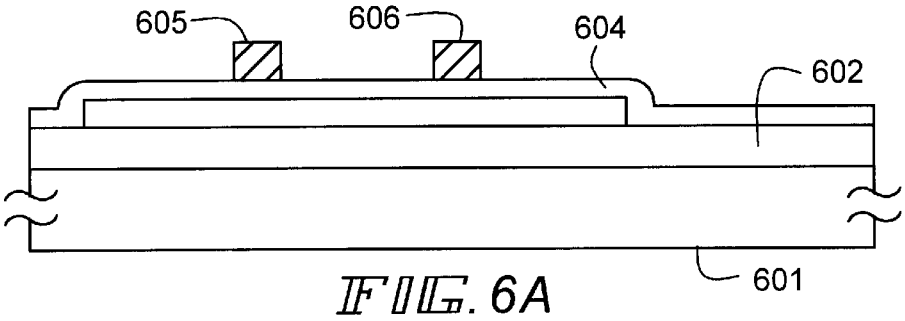
FIG. 6(A)–6(D) show the stages of manufacture of an active matrix circuit element in an example of the present invention.
Figure 6B:
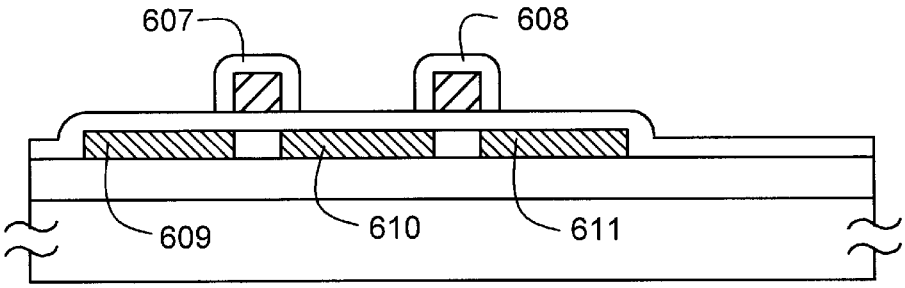
Figure 6C:
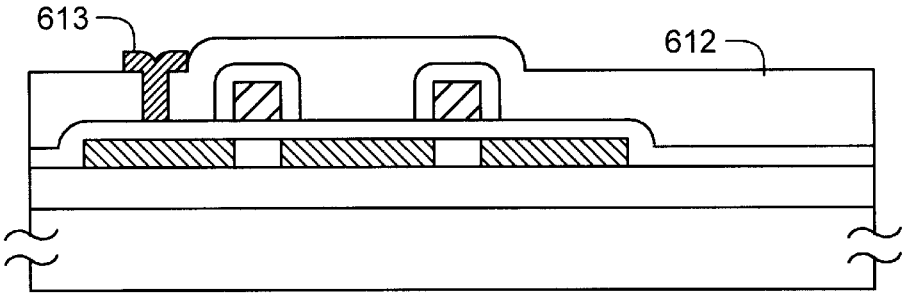
Figure 6D:
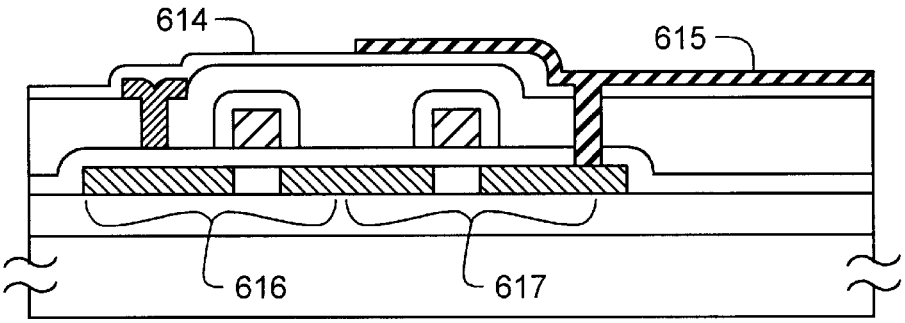

FIGS. 6 (A)–(D) show the process in this example. First, a silicon oxide film 602 was formed to 1000–5000Å, eg, 3000Å as a substrate film on a substrate 601 (Corning 7059, 100 mm×100 mm). This silicon oxide film was formed by decomposition and deposition of TEOS by plasma CVD process. This stage may also be performed by a sputtering process.

Next, an amorphous silicon film was deposited to 300–1500Å, eg, 500Å by plasma CVD process or LPCVD process, and was crystallized by being left for 8–24 hours in a 550– 600° C. atmosphere. Crystallization at this time may be promoted by addition of a very small amount of nickel. Also, this stage may be performed by laser irradiation. The silicon film that had thus been crystallized was etched to form an island region 603, and a gate insulation film 604 was formed on this region. At this time, a silicon oxide film that was 700–1500Å, eg, 1200Å thick was formed by plasma CVD process. This stage may also be performed by sputtering process.

After that, a 1000Å–3 μm, eg, 5000Å thick film of aluminum (containing 1 wt % of Si or 0.1–0.3 wt % of Sc) was formed by sputtering process, and was etched to form gate electrodes 605 and 606. (FIG. 6 (A))

Then anodic oxidation was effected by passing current through the gate electrodes in an electrolytic solution, forming anodic oxidation products that were 500–2500Å, eg, 2000Å thick. The electrolytic solution used is one in which L-tartaric acid is dissolved to a concentration of 5% in ethylene glycol and whose pH is adjusted to 7.0±0.2 with ammonia. The substrate was immersed in this solution, the positive side of a constant current source was connected to the gate electrodes 605 and 606, the negative side was connected to a platinum electrode, voltage was imposed in a constant current state, and oxidation was continued until 150 V was reached. Then, with the voltage constant at 150 V, oxidation was continued until the current became ≦0.1 mA. As a result of this, 2000Å thick anodic oxidation products 607 and 608 were produced.

After that, with the gate electrodes (or, more specifically, the gate electrodes 605 and 606 and the anodic oxidation products 607 and 608 around them) as masks, an impurity (phosphorus in this case) was implanted in a self-aligning manner into the island region 603 by an ion doping procedure, forming N-type impurity regions. Phosphine ($PH_3$) was used as the dopant gas in this case. The dose in this case was $1\times10^{14}$–$5\times10^{15}$ atoms/cm$^2$ and the acceleration voltage was 60–90 kV, eg, the dose was made $1\times10^{15}$ atoms/cm$^2$ and the acceleration voltage 80 kV. As a result of this, N-type impurity regions 609–611 were formed. (FIG. 6 (B))

Further, the impurity regions 609–611 were activated by irradiation with a KrF excimer laser (wavelength 248 nm, pulse width 20 nsec). The laser energy density was suitably 200–400 mJ/cm$^2$, with 250–300 mJ/cm$^2$ being preferable. This stage may also be performed by thermal annealing. The N-type impurity regions 609–611 were formed in this manner, and it is seen that in this example the impurity regions 609–611 are removed from the gate electrodes 605 and 606 by an amount that is the thickness of the anodic oxidation products 607 and 608, and so-called offset gates are produced.

Next, a silicon oxide film 612 was formed, as a layer insulation film, to a thickness of 5000Å by a plasma CVD process. TEOS and oxygen were used for the feed gas at this time. Then, the layer insulation film 612 and gate insulation film 604 were etched, and a contact hole was formed in the N-type impurity region 609. Subsequently, an aluminum film was formed by a sputtering process and etched to form a source electrode lead 613. This is an extension of an image signal line.

After that, a passivation film 614 was formed. In this case, a silicon nitride film was formed to a thickness of 2000–8000Å, eg, 4000Å by a plasma CVD process, using an $NH_3/SiH_4/H_2$ mixed gas, to constitute the passivation film 614. Then, the passivation film 614, layer insulation film 612 and gate insulation film 604 were etched, and a pixel electrode contact hole was formed in the N-type impurity region 611. Then, an indium oxide tin (ITO) film was formed by a sputtering process, and this was etched to form a pixel electrode 615. (FIG. 6 (C))

The above process resulted in formation of an active matrix circuit element possessing N-channel type thin-film transistors 616 and 617. The circuit in this example is the same as the circuit shown in FIG. 1 (A).

The connection of plural thin-film transistors as described in the invention made it possible to reduce the OFF current of a thin-film transistor that drives a pixel electrode. Since deterioration of a thin-film transistor generally depends on the voltage across its source and drain, use of the present invention makes it possible to prevent deterioration.

What is claimed is:

1. A method for driving an active matrix display device comprising:

supplying a first signal in a first stage to a gate of a first transistor provided in an n-th pixel through an n-th gate line, said first transistor being connected with a pixel electrode of said n-th pixel at one of a source and drain of said first transistor; and supplying a second signal in a next stage to a gate of a second transistor provided in said n-th pixel through an (n+1)-th gate line, one of a source and drain of said second transistor being connected with another source and drain of said first transistor, wherein a data is written into said pixel electrode of said n-th pixel when all of the transistors provided in said n-th pixel are ON.

2. A method for driving an active matrix display device comprising:

supplying a first signal in a first stage to a gate of a first transistor provided in an n-th pixel through an n-th gate line, said first transistor being connected with a pixel electrode of said n-th pixel at one of a source and drain of said first transistor; and supplying a second signal in a next stage to a gate of a second transistor provided in said n-th pixel through an (n+1)-th gate line, one of a source and drain of said second transistor being connected with another source and drain of said first transistor, wherein a data is written into said pixel electrode of said n-th pixel when all of the transistors provided in said n-th pixel are ON, and wherein said n-th pixel further has a transistor connected in parallel with one of said first transistor and said second transistor.

3. A method for driving an active matrix display device comprising:

supplying a first signal in a first stage to a gate of a first transistor provided in an n-th pixel through an n-th gate line, said first transistor being connected with a pixel electrode of said n-th pixel at one of a source and drain of said first transistor; and supplying a second signal in a next stage to a gate of a second transistor provided in said n-th pixel through an (n+1)-th gate line, one of a source and drain of said second transistor being connected with another source and drain of said transistor.

wherein a data is written into said pixel electrode of said n-th pixel when all of the transistors provided in said n-th pixel are ON, and wherein said n-th pixel further has a transistor connected in series with said first transistor and said second transistor and kept ON constantly.

* * * * *